United States Patent [19]

Jacobs

[11] 4,062,519

[45] Dec. 13, 1977

[54] PULLEY LIFT ASSEMBLY AND CURTAIN SYSTEM EMPLOYING SAME

[75] Inventor: Lawrence O'Quinn Jacobs, Richmond, Va.

[73] Assignee: Plastic Products, Inc., Richmond, Va.

[21] Appl. No.: 734,518

[22] Filed: Oct. 21, 1976

[51] Int. Cl.[2] ..... B66C 23/60

[52] U.S. Cl. ..... 254/141; 24/81 CC; 24/263 A; 248/228; 254/190 R

[58] Field of Search ..... 254/141, 197, 195, 194, 254/196; 248/72, 228, 226.1; 24/81 CC, 81 PB, 263 A, 263 LS

[56] References Cited

U.S. PATENT DOCUMENTS

| | | | |
|---|---|---|---|
| 535,277 | 3/1895 | Doran et al. | 248/228 X |
| 1,132,999 | 3/1915 | Beers | 248/72 X |
| 1,651,985 | 12/1927 | Allen | 254/141 X |
| 1,820,322 | 8/1931 | Polkosnik | 254/197 |
| 2,553,630 | 5/1951 | Capetta | 254/197 X |
| 2,877,974 | 3/1959 | Estes | 248/228 |
| 3,120,895 | 2/1964 | Mahana et al. | 254/141 X |

FOREIGN PATENT DOCUMENTS

| | | | |
|---|---|---|---|
| 663,403 | 12/1951 | United Kingdom | 248/228 |

*Primary Examiner*—Robert J. Spar
*Assistant Examiner*—Donald W. Underwood
*Attorney, Agent, or Firm*—Norman B. Rainer

[57] ABSTRACT

A multifunctional pulley lift assembly is provided for supporting and lifting a foldable curtain. The assembly is easily attached to an overhead structural beam by means of a horizontally adjustable clamp mechanism. A plurality of said pulley lift assemblies, in proper alignment and provided with lifting cables, are utilized in a curtain raising system wherein said cables are guided by said pulley lift assemblies to a winch mechanism.

5 Claims, 3 Drawing Figures

PULLEY LIFT ASSEMBLY AND CURTAIN SYSTEM EMPLOYING SAME

BACKGROUND OF THE INVENTION

This invention relates to a pulley apparatus adapted to redirect a horizontally applied force into a vertical lifting motion, and more particularly to a pulley apparatus of said adaptation which provides the combined functions of supporting and lifting an elongated foldable structure.

Space divider curtains fabricated of textile or film materials are commonly utilized to divide a large area such as a gymnasium into smaller separate areas. Such curtains are generally hung from ceilings or ceiling support beams, and extend to the floor. In the fully deployed, extended condition, the curtain forms a flexible wall-like barrier which provides visual separation, and serves to confine player-occupants and their equipment such as bats, balls, mats and other items commonly used in a gymnasium.

One manner of storage and deployment of such curtains has involved overhead suspensions or tracks which permits the curtain to be drawn in the horizontal direction so that the gathered curtain, containing vertical folds, can be stored against a wall of the room. Such manner of storage, however, occupies a certain amount of floor space, and could interfere with activities requiring the use of said space or adjoining areas.

Another mode of deployment and storage of a space divider curtain involves a lifting system wherein the curtain is gathered in horizontal folds and drawn to the ceiling. Such ceiling storage does not occupy floor space or interfere with gymnasium activities. Although the ceiling system of curtain storage has its advantages, installation is more difficult than in the case of horizontally drawn, wall-stored curtains.

A ceiling-stored curtain system requires means for attaching the top of the curtain to the ceiling, means such as cables attached at the bottom of the curtain for lifting, guide means such as grommets associated with the curtain to insure proper folding, and a winding mechanism such as a winch device which is preferably motor driven. Because of the generally large size of space divider curtains, a multitude of lifting cables, suitably spaced along the curtain are usually required. This necessitates an equal number of ceiling-mounted fittings to accomodate the cables, and guide means to prevent entanglement of the cables en route to the winding mechanism.

Prior methods of installation of vertically lifted curtains have involved the use of hooks in a ceiling or ceiling beam to support the top of the curtain, additional hooks to mount pulley wheels which accomodate the lifting cables, and separate guides to prevent entanglement of the cables. The use of separate support hooks for the curtain and the pulleys has been necessitated by the fact that the top portion of the curtain would interfere with the lifting of the bottom portion if the top is positioned in the same vertical line followed by the bottom portion in its upward travel. Provision of a separation between the means for holding the top of the curtain and the means for lifting the bottom of the curtain is particularly necessary in the case where both the top edge and the bottom edge of the curtain are wrapped around a pipe or comparable elongated rigid structure which maintains the straightness of the curtain edge.

It is an object of the present invention to provide apparatus for simplifying the installation and operation of a vertically lifted curtain. It is another object to provide a specialized pulley apparatus useful in achieving several functions in the installation and operation of a vertically lifted curtain. It is a still further object of this invention to provide a system comprised of a number of multifunctional pulley devices adapted to work in unison to raise a foldable curtain. Other objects and advantages will become apparent hereinafter.

SUMMARY OF THE INVENTION

The objects of this invention are accomplished in general by providing a pulley lift assembly comprising adjustable clamp means having mounted thereon adjustable curtain support means, a grooved wheel positioned for rotation in a vertical plane, and a cable guard associated with said wheel. Said clamp means is adjustable in the horizontal direction by means of a pair of parallel, horizontally disposed threaded rods arranged one above the other. Said curtain support means, which functions to support and position the upper end of a foldable curtain, is provided with adjustability in the vertical direction by means of a vertically disposed threaded rod. Said grooved wheel is axially mounted by bearing means on the lower of said parallel threaded rods. In a preferred embodiment, said adjustable clamp means is also provided with cable guide means positioned at an elevation close to the top of said wheel and in a manner such that said wheel is located between said cable guide means and said curtain support means.

The present invention also embraces a curtain lifting system comprising a plurality of the aforesaid pulley lift assemblies mounted by their adjustable clamp means to an overhead ceiling beam in a manner such that said grooved wheels are in substantially coplanar alignment and said curtain support means are arranged in a straight horizontal line. Cables which engage with the bottom of the curtain, extend vertically upward, each engaging the grooved periphery of one of said wheels for essentially 90° of turning angle. The cables then pass horizontally through the guides of successive pulley lift assemblies, and advance to a lifting means such as a winch or equivalent hoisting apparatus.

DETAILED DESCRIPTION OF THE INVENTION

Figure 1:
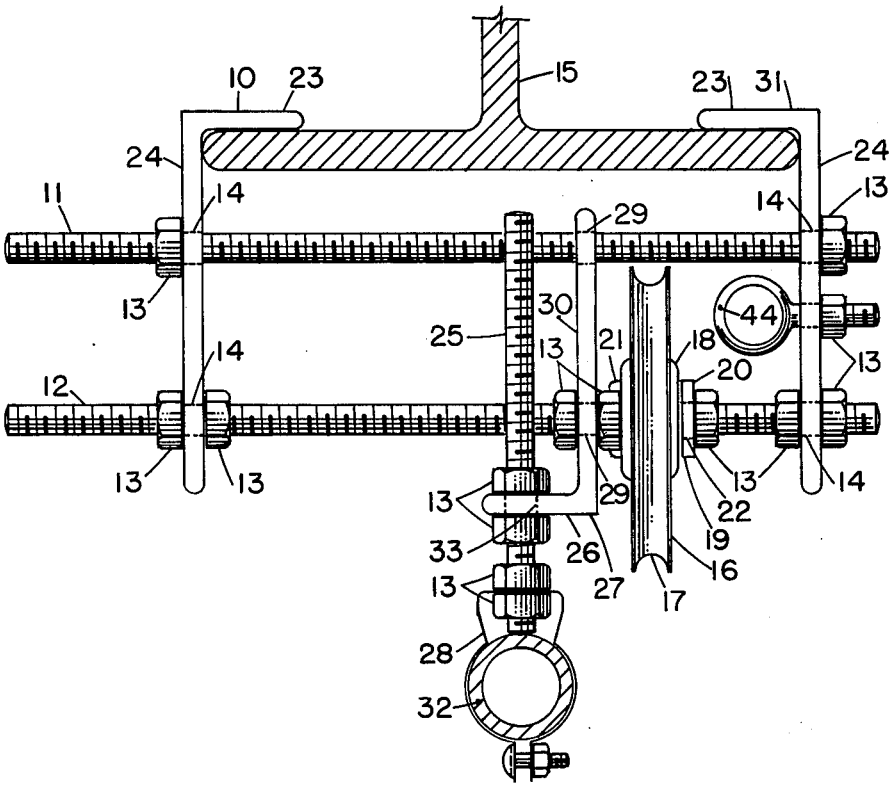
FIG. 1 is a front view of a pulley lift assembly of the present invention.

The pulley lift assembly shown in FIG. 1 contains an adjustable clamping means consisting of a pair of opposed clamp angle bars 10 and 31, each having a vertically disposed long leg 24 and, extending at right angle therefrom, horizontally disposed short leg 23; and parallel threaded rods 11 and 12 arranged one above the other and adapted to pass through close-fitting smooth bore holes 14 in the long legs 24 of angle bars 10 and 31. Threaded nuts 13 maintain said angle bars 10 and 31 in proper position to tightly clamp onto the overhead, ceiling-supporting structural I beam 15.

A wheel 16 containing an outer groove 17 uniformly encompassing its entire periphery, is mounted by center bearing 18 on lower threaded rod 12 in a manner to permit rotation of said wheel in a vertical plane. Threaded nuts 13 maintain the wheel 16 in proper position on lower threaded rod 12.

Figure 2:
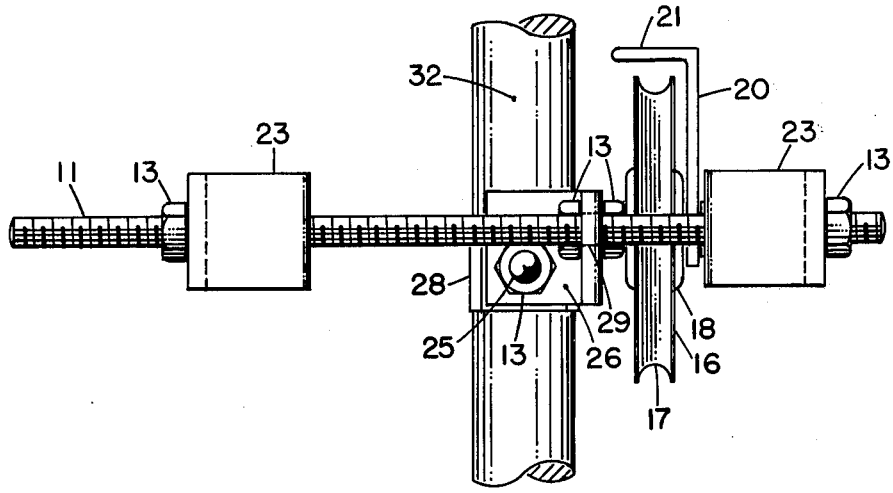
FIG. 2 is a plan view of the pulley lift assembly of FIG. 1.

Cable guard angle bar 19, having a long leg 20 and short leg 21 continuous with an perpendicular to said long leg 20, as shown more clearly in FIG. 2, is mounted on lower threaded rod 12 by means of close-fitting smooth bore hole 22 in that extremity of long leg 20 opposed to short leg 21. The guard angle bar 19 is positioned in a manner such as to enable short leg 21 to extend across outer groove 17 of wheel 16 at the horizontal median of said vertically disposed wheel, as shown more clearly in FIG. 2.

An adjustable curtain support means consisting of vertical threaded rod 25, a support angle bar 27 whose horizontal leg 26 supports said threaded rod 25, and pipe clamp 28 attached to the lower extremity of threaded rod 25, is supported by threaded rods 11 and 12 which pass through close-fitting smooth bore holes 29 in the vertical leg 30 of angle bar 27. The position of angle bar 27 is maintained by threaded nuts 13. Similarly, the elevation of vertical threaded rod 25 is controlled by threaded nuts 13 which engage with said rod where it passes through hole 33 of horizontal leg 26, and abut against same. As shown in FIG. 2, the holes 29 in vertical leg 30 are offset from hole 33 in horizontal leg 26 in order to permit the positioning of threaded rod 25 without interfering with rods 11 or 12. Pipe clamp 28 is adapted to grip a pipe 32 which runs within an upper seam of a suspended curtain.

A cable guide means consisting of eyebolt 44 is fastened to vertical leg 24 of clamp angle bar 31 by means of threaded nut 13. The position of said eyebolt 44 is such that its generally circular opening or eye portion lies in an essentially vertical plane, and said eyebolt is located at an elevation close to the top of wheel 16, and on the side of said wheel opposite to the side facing support angle bar 27.

Figure 3:
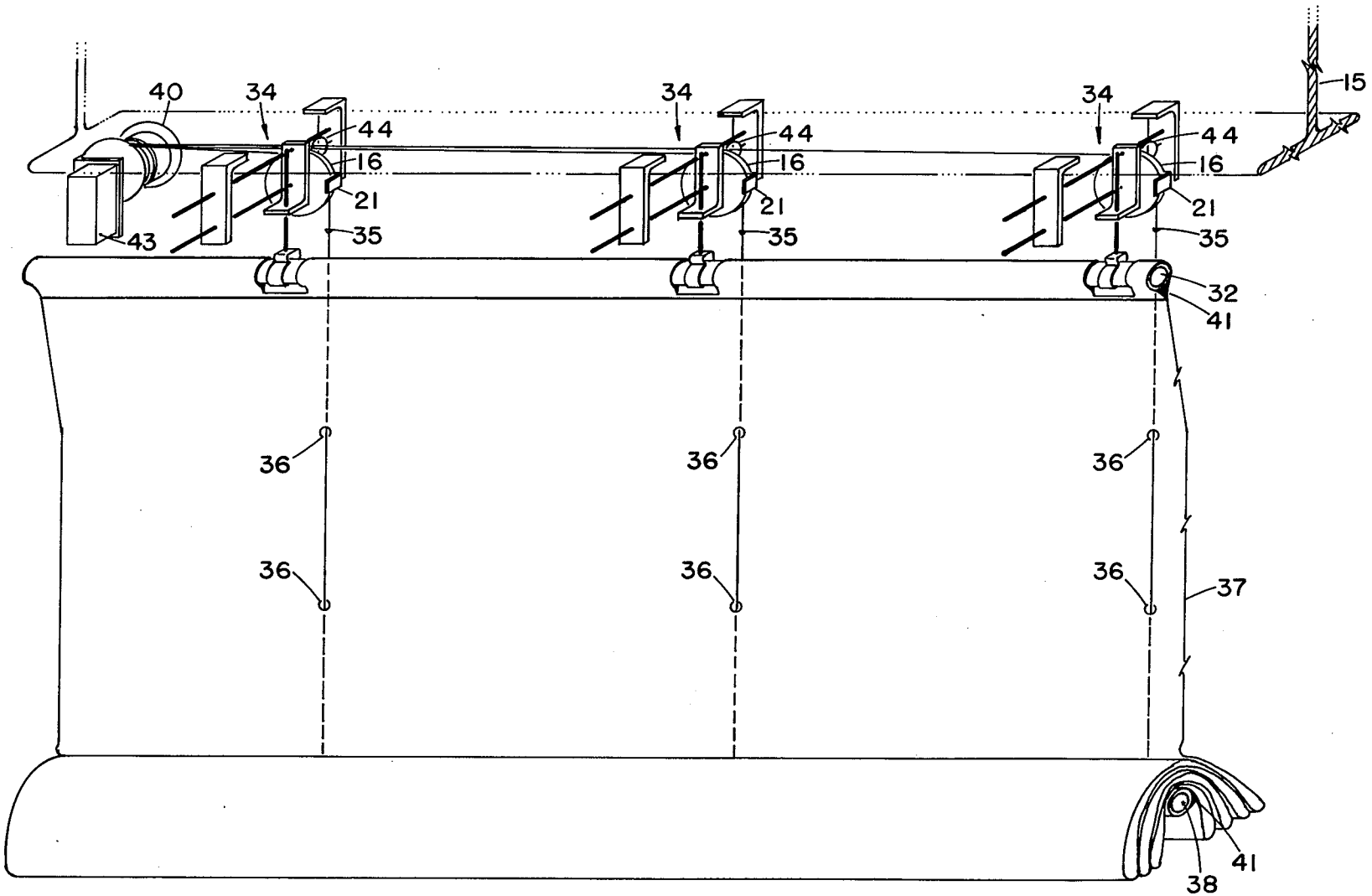
FIG. 3 is a fragmentary perspective view of a vertically lifting curtain system incorporating a number of the pulley lift assemblies of FIG. 1.

FIG. 3 illustrates a portion of a curtain system utilizing several pulley lift assemblies 34 of the present invention equally spaced on an overhead structural I-beam 15. Each pulley lift assembly functions in association with a cable 35 attached to pipe 38 located in seamed loop 41 at the bottom edge of curtain 37. The cables then proceed through vertically grouped curtain guides such as grommets 36 in said curtain. At the top of its vertical path, each cable passes under short leg 21 of cable guard angle bar 19, entering groove 17 of wheel 16. The cable remains in contact with the wheel for 90° of turning radius, at which point it departs from the wheel in the horizontal direction and passes through eyebolts 44 of successive pulley lift assemblies en route to winch drum 40.

The curtain of FIG. 3 contains pipe 32 within seamed loop 41 running the entire upper edge of said curtain. The pipe 32 is supported at each pulley lift assembly 34 by adjustable curtain support means consisting of the aforementioned vertical threaded rod 25, support angle bar 27, and pipe clame 28. Pipe 32 is spaced far enough from the vertical path of cable 35 so as to avoid contact with same.

In operation, activation of winch drum 40 by motor 43 causes the bottom of curtain 37 to be lifted by cables 35 acting in unison on pipe 38. The spacing of vertically aligned grommets 36 is such as to cause the curtain to fold in uniform back and forth hanging layers centered over pipe 38.

Angled structural members 10, 31, 27, and 19 employed in the pulley lift assembly are preferably of integral steel construction, having been shaped by extrusion or bending and cutting to suitable size. Although the several holes in said angled members have been exemplified as being of smooth bore, threaded holes may alternatively be utilized, which in some instances may obviate the need for associated threaded nuts.

The cable guide means, exemplified hereinabove as eyebolt 44, consists essentially of a confining means which permits unimpeded passage of the cables while restricting their lateral motion. The guide means may be circular or non-circular and may have a gate-like opening to facilitate string-up, and may have other features of adjustability to simplify installation of the curtain raising system.

The grooved wheel 16 is preferably positioned in a manner such that upper threaded rod 11 is located at a sufficient height above said wheel so as to function to keep the cable from leaving groove 17. Such spacing is shown in FIG. 1, wherein it is seen that the juxtaposition of the wheel and upper threaded rod is such as to permit passage of the cable while preventing its escape from groove 17. In some embodiments, a smooth bearing surface or sleeve may be applied to the threaded rod at a site above said wheel in order to prevent abrasive contact with the cable.

The preferred bearing means 18 for grooved wheel 16 is a ball bearing system. However, other bearing means may be utilized such as bronze or graphite bushings and equivalent bearing materials and structures known to the art.

The term "cable" as used herein is intended to denote any strong, thin, flexible strand, generally a multifilamentary structure having a twisted or braided configuration. Suitable cables may be fabricated of steel wire, fiberglass, or high tenacity continuous filaments of synthetic polymeric material such as polyester and polyanide. The cable may be coated or jacketed with an adherent abrasion resistant material.

The lower threaded rod 12 can, in certain embodiments, extend beyond clamp angle bar 31 for sufficient distance to permit the mounting of other devices useful in the curtain raising system. One such device is a track for guiding a tie-plate to which are attached a number of cables. The tie-plate is employed in certain embodiments of curtain raising systems to minimize the amount of cable required. Other features which can be associated with the clamping means include valence-type structures which may conceal the curtain in the raised position, and additional features of interest to gymnasium activities.

Although FIG. 3 illustrates a winch drum mounted beneath the beam adjacent the end of the upper edge of the curtain, the winch drum or equivalent hoisting apparatus may be positioned differently. For example, if a hand-operated winch is to be utilized, it must be located closer to floor level where it is more readily accessible. In such instances, a pulley mounted on the beam or wall may be employed to receive the horizontally directed cables and re-direct them downwardly to a wall mounted winch located closer to floor level. In still another embodiment, particularly where it is desired to have the curtain extend as close as possible to the wall, the horizontally directed cables may be re-directed by means of a pulley to an adjacent ceiling beam on which the hoist mechanism is mounted.

Having thus described my invention, I claim:

1. A vertically lifting curtain system comprising:

a. a plurality of pulley lift assemblies, each comprised of a horizontally adjustable clamp means adapted to engage with an overhead beam, said clamp means having mounted thereon: 1) vertically adjustable means for supporting a curtain, 2) a grooved wheel positioned for rotation in a vertical plane and adapted to receive a cable utilized for the lifting of said curtain, and 3) a cable guard adapted to maintain said cable in contact with said wheel, and 4) cable guide means, said assemblies being mounted by their adjustable clamp means in spaced relationship on an overhead beam and aligned such that the grooved wheels of said assemblies are essentially coplanar, b. a curtain having horizontally disposed upper and lower edges, each maintained in straight configuration by engagement with a rigid elongated member traversing its entire length, and spaced groups of vertically aligned guides, said curtain being supported by said vertically adjustable means which attach to the rigid elongated member engaging the upper edge of said curtain, c. a cable associated with each of said pulley lift assemblies, said cable being connected to the rigid elongated member engaging the bottom of said curtain, and extending through a group of vertically aligned guides in said curtain, entering onto the grooved wheel of said assembly for essentially 90° of turning angle, leaving said wheel in a substantially horizontal direction, passing through cable guide means associated with said pulley lift assemblies, and communicating with d. winding means adapted to act on said cables in unison.

2. A pulley lift assembly comprising horizontally adjustable clamp means adapted to engage with an overhead beam, said clamp means having mounted thereon: (1) vertically adjustable means for supporting a curtain by attachment adjacent the top edge thereof, (2) a grooved wheel positioned for rotation in a vertical plane and adapted to receive a cable utilized for the lifting of at least a lower edge of said curtain, (3) a cable guard adapted to extend across the groove of said wheel at substantially the horizontal median of said wheel in a manner such that said cable will pass between said groove and said guard and (4) cable guide means for another cable utilized for the lifting of said curtain positioned in a manner such that said guide means and said vertically adjustable means are located on opposite sides of said wheel.

3. The pulley lift assembly of claim 2 wherein said horizontally adjustable clamp means comprises a pair of opposed angle bars, each having a vertically disposed leg and a horizontially disposed leg, and a pair of threaded rods arranged in parallel juxtaposition one above the other and adapted to engage with the vertically disposed legs of said angle bars.

4. The pulley lift assembly of claim 3 wherein said grooved wheel is mounted on one of said threaded rods.

5. The pulley lift assembly of claim 3 wherein said vertically adjustable support means comprises an angle bar having a vertically disposed leg and horizontally disposed leg, said vertically disposed leg being supported by engagement with said pair of threaded rods, and a vertically disposed threaded rod adjustably supported by said horizontally disposed leg and possessing holding means at its lower end adapted to grip a pipe or similar object.

* * * * *